US009625162B2

(12) United States Patent
Yoshimura et al.

(10) Patent No.: US 9,625,162 B2
(45) Date of Patent: Apr. 18, 2017

(54) HEATING COOKER

(75) Inventors: Kazushi Yoshimura, Osaka (JP); Kazushi Furukawa, Osaka (JP); Masahiro Nishijima, Osaka (JP); Hiromi Suenaga, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 1090 days.

(21) Appl. No.: 12/999,518

(22) PCT Filed: Jul. 24, 2009

(86) PCT No.: PCT/JP2009/063262

§ 371 (c)(1),
(2), (4) Date: Dec. 16, 2010

(87) PCT Pub. No.: WO2010/013650

PCT Pub. Date: Feb. 4, 2010

(65) Prior Publication Data

US 2011/0126819 A1 Jun. 2, 2011

(30) Foreign Application Priority Data

Jul. 30, 2008 (JP) ..... 2008-195621
Jan. 27, 2009 (JP) ..... 2009-014893

(51) Int. Cl.
*F24C 15/32* (2006.01)
*F24C 15/16* (2006.01)

(52) U.S. Cl.
CPC ..... *F24C 15/322* (2013.01); *F24C 15/16* (2013.01)

(58) Field of Classification Search
CPC ..... F24C 15/322; F24C 1/00; F24C 15/32; F24C 15/2007; F24C 15/16; F24C 15/325;

(Continued)

(56) References Cited

U.S. PATENT DOCUMENTS 3,384,068 A * 5/1968 Perry et al. ..... 126/21 A
3,658,047 A * 4/1972 Happel ..... F24C 15/322 126/21 A (Continued)

FOREIGN PATENT DOCUMENTS

CN 1696573 A 11/2005
DE 102005059505 * 6/2007 ..... F24C 15/327

(Continued)

OTHER PUBLICATIONS

Bakker, Boundary Layers and Separation (2002).*

*Primary Examiner* — Kenneth Rinehart
*Assistant Examiner* — Jason Lau
(74) *Attorney, Agent, or Firm* — Birch, Stewart, Kolasch & Birch, LLP

(57) ABSTRACT

A cooker is equipped with a heating chamber having an open part in the front surface and holding an object to be cooked, an opening/closing door having a see-through window and opens and closes the open part, a suction intake opening opened in one of the side walls that faces the heating chamber, an air discharge outlet opened in the other side wall of the heating chamber, and a circulation duct having first and second side surface parts provided outside of the two side walls of the heating chamber and connecting the suction intake opening provided at the first side surface part and the air discharge outlet provided at the second side surface part. The cooker further includes a circulation fan provided inside the circulation duct and drawing in gas inside the heating chamber through the suction intake opening and blows it out through the air discharge outlet.

12 Claims, 5 Drawing Sheets

(58) Field of Classification Search
CPC ..... F24C 15/327; H05B 6/6473; A21B 3/04; A21B 1/26; A47J 39/003
USPC ..... 126/21 A; 219/400
See application file for complete search history.

(56) References Cited

U.S. PATENT DOCUMENTS

| | | | | | |
|---|---|---|---|---|---|
| 4,029,463 | A | * | 6/1977 | Johansson et al. | 432/25 |
| 4,481,396 | A | * | 11/1984 | Matsubayashi et al. | 219/681 |
| 5,038,748 | A | * | 8/1991 | Lockwood et al. | 126/19 R |
| 5,529,052 | A | * | 6/1996 | Sanchez | 126/21 A |
| 5,615,603 | A | * | 4/1997 | Polin | 99/331 |
| 5,676,870 | A | * | 10/1997 | Wassman et al. | 219/400 |
| 5,693,242 | A | * | 12/1997 | Sanchez | 219/400 |
| 5,798,505 | A | * | 8/1998 | Lee | 219/681 |
| 5,813,393 | A | * | 9/1998 | Persson et al. | 126/21 A |
| 6,566,638 | B2 | * | 5/2003 | Brown | 219/681 |
| 6,880,544 | B2 | * | 4/2005 | Hegge et al. | 126/20 |
| 7,205,507 | B2 | * | 4/2007 | LoMaglio et al. | 219/400 |
| 7,241,976 | B2 | * | 7/2007 | Andoh et al. | 219/401 |
| 7,329,847 | B2 | * | 2/2008 | Tatsumu et al. | 219/681 |
| 2003/0205222 | A1 | * | 11/2003 | Rabas et al. | 126/21 A |
| 2004/0025910 | A1 | | 2/2004 | Kanzaki et al. | |
| 2004/0107953 | A1 | * | 6/2004 | Hegge et al. | 126/21 A |
| 2007/0107712 | A1 | * | 5/2007 | Shiraichi et al. | 126/21 A |
| 2008/0105249 | A1 | * | 5/2008 | McFadden et al. | 126/21 A |
| 2009/0205625 | A1 | * | 8/2009 | Matsubayashi et al. | 126/21 A |

FOREIGN PATENT DOCUMENTS

| | | | | |
|---|---|---|---|---|
| JP | 9-126461 | A | | 5/1997 |
| JP | 9-126462 | A | | 5/1997 |
| JP | 2005-114350 | A | | 4/2005 |
| JP | 2005-265227 | A | | 9/2005 |
| WO | WO 2007138953 | A1 | * | 12/2007 |

* cited by examiner

HEATING COOKER

TECHNICAL FIELD

The present invention relates to a heating cooker that performs cooking by circulating gas in a heating chamber.

BACKGROUND ART

Patent Document 1 discloses a conventional heating cooker. This heating cooker includes a heating chamber that has an opening portion at its front surface and houses an object to be cooked. The opening portion of the heating chamber is opened and closed by an open/close door having a see-through window made of heat-resistant glass or the like. The open/close door is filled with a thermal insulation material. Further, a steam supply portion that supplies steam into the heating chamber is provided below the heating chamber.

At the rear of the heating chamber, a circulation duct is provided in which a circulation fan and a heater are disposed. A suction port is open in a center portion of a wall behind the heating chamber, and a blow-off port is open in a surrounding portion of the wall, which surrounds the center portion. The heating chamber and the circulation duct communicate with each other via the suction port and the blow-off port.

When cooking is started, steam is supplied into the heating chamber by the steam supply portion. Furthermore, the circulation fan is driven to cause the steam in the heating chamber to flow into the circulation duct through the suction port on a back surface of the heating chamber. The steam flowing through the circulation duct is heated by the heater and then is blown off forward through the blow-off port provided in the surrounding portion of the wall behind the heating chamber. By this configuration, steam in the heating chamber circulates via the circulation duct and is maintained at a predetermined temperature. An object to be cooked is cooked by the steam at the predetermined temperature, and the progress of cooking can be checked through the see-through window.

Prior Art Document

Patent Document

Patent Document 1: JP-A-2005-114350 (Pages 3 to 8, FIG. 9)

DISCLOSURE OF THE INVENTION

Problems to be Solved by the Invention

According to the above-described conventional heating cooker, however, steam is blown off forward through the blow-off port and thus impacts against the open/close door to raise the temperature of the open/close door. In order to avoid possible danger resulting from the open/close door being raised to a high temperature, the open/close door and the see-through window are formed in increased thicknesses so that high thermal resistance is maintained. This has led to a problem that the volume ratio of the heating chamber is decreased. Also, there has been another problem that steam coming into contact with the see-through window, which is exposed to the outside air and thus is at a lower temperature, causes large heat loss, resulting in lowering heating efficiency.

It is an object of the present invention to provide a heating cooker that can achieve improvements in the volume ratio of a heating chamber and in heating efficiency.

Means for Solving the Problem

In order to achieve the above-described object, the present invention is characterized by including: a heating chamber that has an opening portion at a front surface thereof and houses an object to be cooked; an open/close door that has a see-through window and by which the opening portion is opened and closed; a suction port that is open on one of opposed side walls of the heating chamber; a blow-off port that is open on the other of the side walls of the heating chamber; a circulation duct that has first and second side surface portions disposed outside the side walls of the heating chamber, respectively, and connects the suction port provided in the first side surface portion to the blow-off port provided in the second side surface portion; and a circulation fan that is provided in the circulation duct and causes gas in the heating chamber to be sucked through the suction port and blown off through the blow-off port.

According to this configuration, upon driving of the circulation fan, gas such as steam or air in the heating chamber flows into the first side surface portion of the circulation duct through the suction port provided on one of the side walls of the heating chamber. The gas that has flowed into the first side surface portion is guided to the second side surface portion provided on the other of the side walls and then is blown off into the heating chamber through the blow-off port, and thus an object to be cooked is cooked by hot air.

Furthermore, the present invention is characterized in that, in the heating cooker having the above-described configuration, a heating portion that heats gas flowing through the circulation duct is provided in the circulation duct. According to this configuration, gas flowing through the circulation duct is heated by the heating portion, and thus the temperature of gas in the heating chamber is maintained at a predetermined temperature.

Furthermore, the present invention is characterized in that, in the heating cooker having the above-described configuration, the circulation duct connects the first and second side surface portions to each other via a top surface portion provided above the heating chamber, and the heating portion is disposed in the top surface portion. According to this configuration, gas that has flowed from inside the heating chamber into the first side surface portion of the circulation duct via the suction port is guided to the top surface portion. The gas is heated to a predetermined temperature by the heating portion in the top surface portion and then flows through the second side surface portion to be blown off into the heating chamber through the blow-off port. An object to be cooked is heated by the gas blown off through the blow-off port and by heat radiation from the heating chamber disposed in the top surface portion.

Furthermore, the present invention is characterized in that, in the heating cooker having the above-described configuration, a plurality of small holes facing the heating chamber are provided in the top surface portion. According to this configuration, gas flowing through the circulation duct is heated by the heating portion in the top surface portion, and part of the gas is blown off from an upper surface into the heating chamber via the small holes.

Furthermore, the present invention is characterized in that, in the heating cooker having the above-described configuration, a placing base on which a mounting tray for mounting an object to be cooked is placed is provided in a protruding manner on an inner wall of the heating chamber, and the suction port is disposed at a position below and above the position of the placing base. According to this configuration, the mounting tray on which an object to be cooked is mounted is placed on the placing base. Gas that has passed through the top surface portion and then been blown off toward an obliquely downward direction into the heating chamber through the blow-off port in the second side surface portion flows in an ascending manner in the heating chamber and then is sucked into the suction port at a position upper than the position of the placing base.

Furthermore, the present invention is characterized in that, in the heating chamber having the above-described configuration, a plurality of the placing bases are provided at different vertical levels. Further, the blow-off port is disposed at a position lower than the positions of upper ones of the placing bases, and a protrusion that protrudes in the direction of the heating chamber is provided on an inner wall of the second side surface portion, which is distant from the heating chamber. According to this configuration, gas flowing through the second side surface portion of the circulation duct is blown off through the blow-off port in such a manner as to be dispersed in the respective directions of objects to be cooked at upper and lower levels. At this time, the amounts of the gas to be blown in the respective directions are adjusted by adjusting the disposition and size of the protrusion.

Furthermore, the present invention is characterized in that, in the heating cooker having the above-described configuration, a connection portion is provided that connects the top surface portion to the second side surface portion and thus makes the circulation duct bent, and an inner surface of the connection portion is constituted by a wall surface of the heating chamber. According to this configuration, gas heated in the top surface portion passes through the connection portion that is in contact with the heating chamber and then is guided to the second side surface portion.

Furthermore, the present invention is characterized in that, in the heating cooker having the above-described configuration, a box-shaped body of a closed-bottom tubular shape is provided that is formed by a single member constituting the peripheral and back surfaces of the heating chamber. Further, the top surface portion protrudes to the inner side of the box-shaped body, and the inner surface of the connection portion is constituted by an isolation plate disposed on the inner side of the box-shaped body. According to this configuration, the connection portion is formed on the inner side of the box-shaped body.

Furthermore, the present invention is characterized in that, in the heating cooker having the above-described configuration, the isolation plate is formed by a curved plate.

Furthermore, the present invention is characterized in that, in the cooking heater having the above-described configuration, the respective outer surfaces of the top surface portion, the connection portion, and the second side surface portion are formed integrally using a common member.

Furthermore, the present invention is characterized in that, in the heating cooker having the above-described configuration, a steam supply portion that supplies steam to the heating chamber is provided. According to this configuration, steam is supplied from the steam supply portion into the heating chamber, and cooking is performed using the steam circulating via the circulation duct.

Advantages of the Invention

According to the present invention, the suction port that is open on one of the opposed side walls of the heating chamber and the blow-off port that is open on the other of the side walls are connected by the circulation duct so that gas in the heating chamber is circulated therethrough, and thus the gas is blown off in the lateral direction through the blow-off port. This configuration suppresses impacting of heated gas against the open/close door having the see-through window. Consequently, the open/close door can be formed in a reduced thickness and the heating chamber thus can be increased in volume, so that the volume ratio of the heating chamber can be improved. The above-described configuration also suppresses contact between gas and the see-through window, which is exposed to the outside air and thus is at a lower temperature, so that heat loss can be reduced and heating efficiency of the heating cooker thus can be improved.

BEST MODE FOR PERFORMING THE INVENTION

Figure 1:
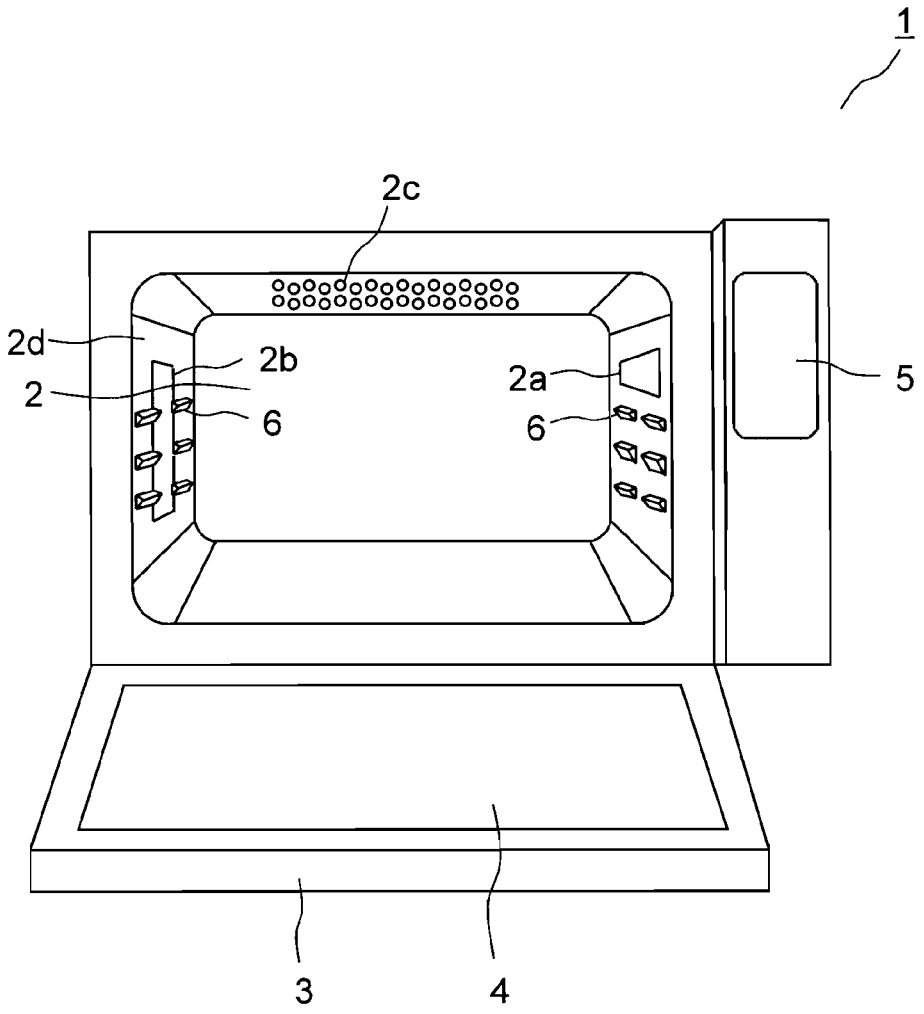
FIG. 1 A perspective view showing a heating cooker according to a first embodiment of the present invention.

Hereinafter, embodiments of the present invention will be described with reference to the appended drawings. FIG. 1 is a perspective view showing a heating cooker according to a first embodiment. A heating cooker 1 includes a heating chamber 2 that has an opening portion 2*d* at its front surface and houses an object to be cooked, and the opening portion 2*d* is opened and closed by an open/close door 3 that is supported pivotably at a lower end thereof. The heating chamber 2 is formed by a box-shaped body 2*e* of a closed-bottom tubular shape that is a single member formed by draw processing or the like, and the peripheral and back surfaces of the heating chamber 2 are constituted by the box-shaped body 2*e*. The open/close door 3 is filled with a thermal insulation material, and in a center portion thereof, a see-through window 4 made of heat-resistant glass or the like is provided for viewing an inner portion of the heating chamber 2. On the right lateral side of the heating chamber 2, an operation portion 5 is provided through which an input operation or the like is performed.

Figure 2:
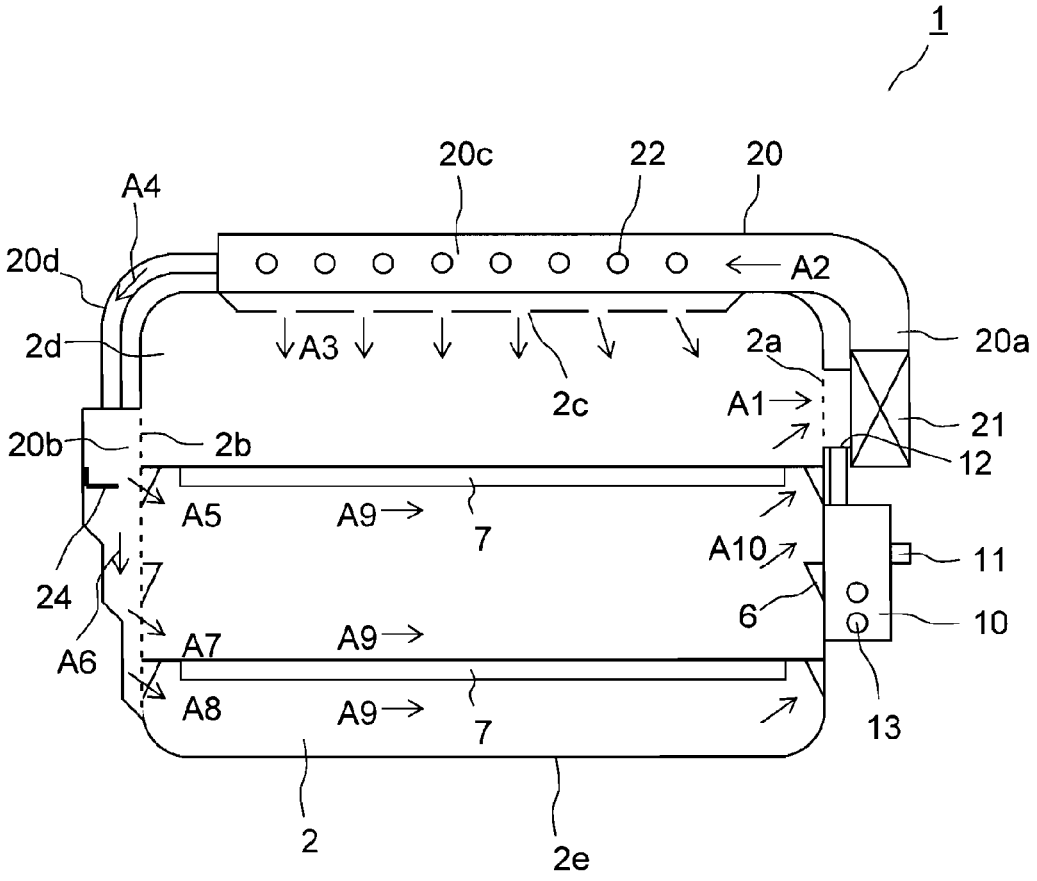
FIG. 2 A cross-sectional front view showing an inner portion of the heating cooker according to the first embodiment of the present invention.

FIG. 2 shows a cross-sectional front view of an inner portion of the heating cooker 1. A steam supply portion 10 is mounted to a lower portion of a right side wall of the heating chamber 2. The steam supply portion 10 is composed of a metal container having a water supply port 11 as well as a discharge port 12 and a steam generation heater 13 that is formed by a sheathed heater and embedded in the metal container. Water for steam generation is supplied from a detachable water supply tank (not shown) through the water supply port 11. The steam generation heater 13 generates steam by evaporating water supplied through the water supply port 11. The discharge port 12 is open to a circulation duct 20, which will be described later, and steam generated by the steam supply portion 10 is discharged to an upstream side of a circulation fan 21 through the discharge port 12.

A plurality of placing bases 6 on which mounting trays 7 for mounting an object to be cooked are placed are provided at different levels in the vertical direction on both the side walls of the heating chamber 2. This allows cooking to be performed in a state where the mounting trays 7 are placed at a plurality of vertical levels. Incidentally, an opening that allows airflow to pass therethrough is provided in a grip portion on the periphery of each of the mounting trays 7.

A suction port 2*a* is open in an upper portion of the right side wall of the heating chamber 2, and blow-off ports 2*b* and 2*c* are open on a left side wall and a ceiling wall of the heating chamber 2, respectively. The suction port 2*a* is disposed at a position upper than the positions of upper ones of the placing bases 6. The blow-off port 2*b* is open in a wide range from above the upper ones of the placing bases 4 to below lower ones of the placing bases 4. The blow-off port 2*b* may be provided so as to be divided into upper and lower portions. The blow-off port 2*c* is made up of a multitude of small holes.

The suction port 2*a* and the blow-off port 2*b* are connected by the circulation duct 20 disposed outside the heating chamber 2. The circulation duct 20 has first and second side surface portions 20*a* and 20*b* and a top surface portion 20*c*. The suction port 2*a* is provided in the first side surface portion 20*a*, and the blow-off port 2*b* is provided in the second side surface portion 20*b*. Furthermore, the top surface portion 20*c* is provided so as to protrude to the inner side of the box-shaped body 2*e*, and the blow-off port 2*c* is provided in the top surface portion 20*c*. The top surface portion 20*c* is connected to the second side surface portion 20*b* by a connection portion 20*d* that is made up of a plurality of pipes and causes the circulation duct 20 to be bent.

The circulation fan 21 and a heater 22 are provided in the circulation duct 20. The circulation fan 21 is formed by a centrifugal fan or the like and causes steam in the heating chamber 2 to be taken into the circulation duct 20 through the suction port 2*a*. The steam flowing through the circulation duct 20 is blown off into the heating chamber 2 through the blow-off ports 2*b* and 2*c*. By this configuration, steam in the heating chamber 2 circulates via the circulation duct 20.

The heater 22 is formed by a sheathed heater and disposed in the top surface portion 20*c* where it heats steam flowing through the circulation duct 20. Thus, steam is maintained at a predetermined temperature, which enables cooking by saturated steam or overheated steam. Also, an object to be cooked is heated by radiant heat emitted from the heater 22 disposed in the top surface portion 20*c* into the heating chamber 2. The heater 22 may also be formed by an IH heater.

Figure 3:
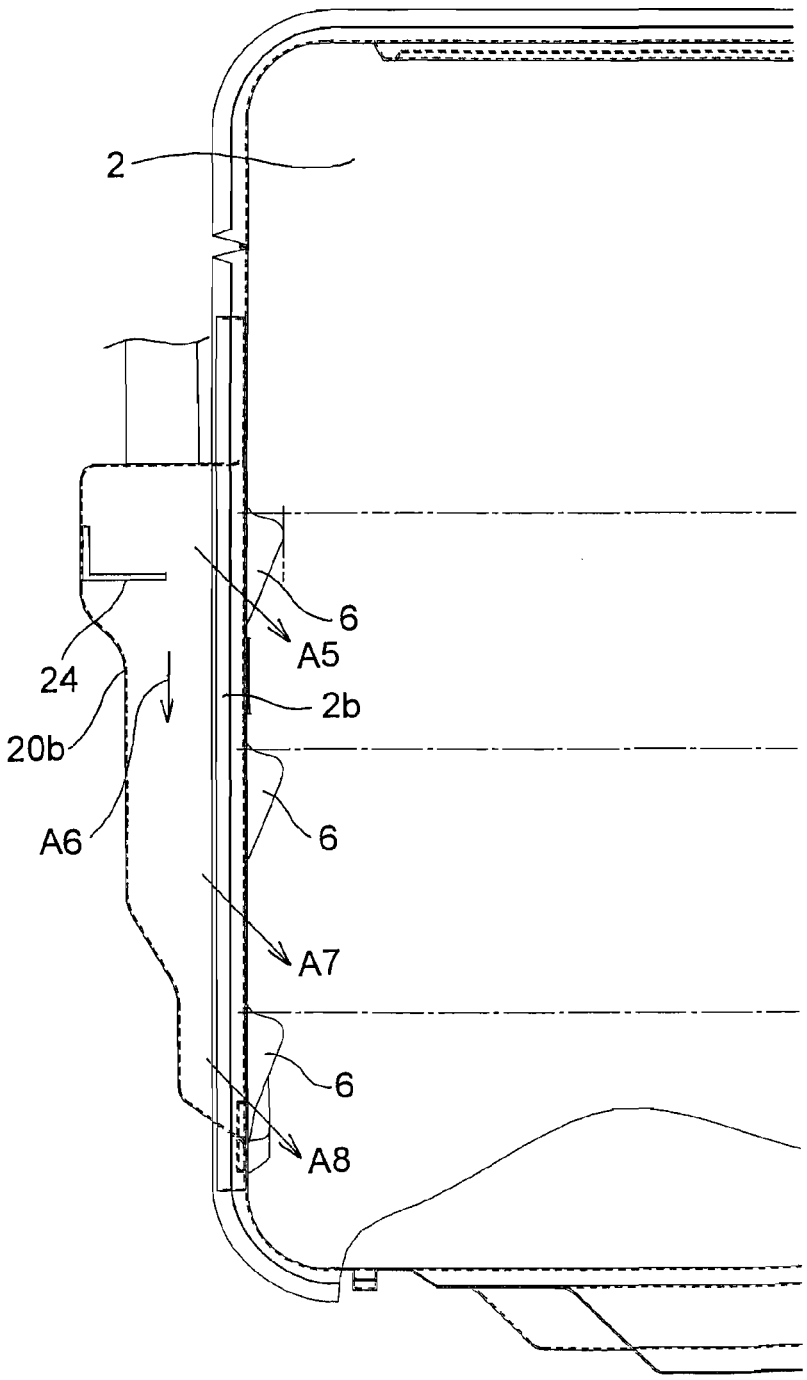
FIG. 3 A cross-sectional front view showing a second side surface portion of the heating cooker according to the first embodiment of the present invention.

FIG. 3 is a cross-sectional front view showing the second side surface portion 20*b* in detail. In the second side surface portion 20*b*, a protrusion 24 is provided that protrudes in the direction of the heating chamber 2 from an inner wall of the second side surface portion 20*b*, which is distant from the heating chamber 2. The disposition and length of the protrusion 24 are adjusted so as to control the flow of steam before being blown off through the blow-off port 2*b*. Thus, the amounts of steam to be used to heat the lower surface of an object to be cooked at an upper level and the upper and lower surfaces of an object to be cooked at a lower level, respectively, are made appropriate, which allows cooking to be performed in a favorable manner.

In the heating cooker 1 having the above-described configuration, when objects to be cooked are mounted on the mounting trays 7 and cooking is started in that state, water is supplied from the water supply tank (not shown) to the steam supply portion 10 via the water supply port 11. The water supplied to the steam supply portion 10 is evaporated by the steam generation heater 13 to form steam that then is discharged into the circulation duct 20 through the discharge port 12. Under a state where the heater 22 is energized, the upper surface of the object to be cooked at the upper level is heated by radiant heat from the heater 22.

Upon driving of the circulation fan 21, the steam that has flowed into the circulation duct 20 through the discharge port 12 flows through the circulation duct 20. Furthermore, steam that has been blown off into the heating chamber 2 flows into the circulation duct 20 via the suction port 2*a* as shown by an arrow A1 and flows through the circulation duct 20. The steam that has been taken into the circulation duct 20 is guided from the first side surface portion 20*a* to the top surface portion 20*c* as shown by an arrow A2. The temperature of the steam flowing through the top surface portion 20*c* is raised by heat exchange with the heater 22. At this time, the steam may be maintained at a temperature near 100° C. so as to enable cooking by saturated steam or at a temperature not lower than 100° C. (e.g., 300° C.) so as to enable cooking by overheated steam.

Part of the steam whose temperature has been raised by the heater 22 in the top surface portion 20*c* is blown off through the blow-off port 2*c* as shown by an arrow A3. Thus, the upper surface of the object to be cooked at the upper level is heated by hot air. The rest of the steam is guided to the second side surface portion 20*b* as shown by an arrow A4.

Due to the protrusion 24, part of the steam flowing downstream through the second side surface portion 20*b* is blown off to a region below an upper one of the mounting trays 7 through the blow-off port 2*b* as shown by an arrow A5. The steam flowing further downstream beyond the protrusion 24 as shown by an arrow A6 is blown off to regions above and below a lower one of the mounting trays through the blow-off port 2*b* as shown by arrows A7 and A8, respectively. At this time, since the steam flows downstream from the top surface portion 20*c* toward the second side surface portion 20*b*, the steam is blown off in an obliquely downward direction through the blow-off port 2*b*. The steam that has been blown off into the heating chamber 2 flows toward the right side wall as shown by an arrow A9. By this steam, the lower surface of the object to be cooked at the upper level and the upper and lower surfaces of the object to be cooked at the lower level are heated.

The steam that has been blown off through the blow-off port 2*c* is sucked in the direction of the suction port 2*a* and guided to the suction port 2*a*. Furthermore, the steam flowing through the heating chamber 2 toward the right side wall flows in an ascending manner as shown by an arrow A10 and guided to the suction port 2*a*. At this time, since the suction port 2*a* is disposed at a position upper than the positions of the upper ones of the placing bases 6, the steam that has been blown off in the obliquely downward direction through the blow-off port 2*b* begins to ascend substantially at a middle portion in the left-right direction of the heating chamber 2. Thus, a uniform temperature distribution can be obtained in the horizontal direction in the heating chamber 2.

According to the present embodiment, the suction port 2*a* that is open on one of the opposed side walls of the heating chamber 2 and the blow-off port 2*b* that is open on the other of the side walls are connected by the circulation duct 20 so that steam in the heating chamber 2 is circulated therethrough, and thus the steam is blown off in the lateral direction through the blow-off port 2*b*. This configuration suppresses impacting of heated steam against the open/close door 3 having the see-through window 4. Consequently, the open/close door 3 can be formed in a reduced thickness and the heating chamber 2 thus can be increased in volume, so that the volume ratio of the heating chamber 2 can be improved. The above-described configuration also suppresses contact between steam and the see-through window 4, which is exposed to the outside air and thus is at a lower temperature, so that heat loss can be reduced and heating efficiency of the heating cooker 1 thus can be improved.

Furthermore, since the heater 22 (heating portion) that heats steam flowing through the circulation duct 20 is provided in the circulation duct 20, the steam can be easily maintained at a predetermined temperature.

The circulation duct 20 may also be configured to connect the first and second side surface portions 20*a* and 20*b* to each other via a region below or behind the heating chamber 2. It is to be noted, however, that since the circulation duct 20 connects the first and second side surface portions 20*a* and 20*b* to each other via the top surface portion 20*c* and the heater 22 is disposed in the top surface portion 20*c*, an object to be cooked can be easily heated by radiant heat from the heater 22, and thus heating efficiency can be improved further.

Furthermore, since the top surface portion 20*c* is provided, it is possible to reduce the depth dimension of the heating cooker 1 while securing a large depth dimension of the heating chamber 2. Thus, a large-sized object to be cooked such as a large-diameter pizza (e.g., 36 cm in diameter) can be cooked by the heating cooker 1, and the heating cooker 1 can be installed on a cooking table with a reduced depth dimension (e.g., 45 cm in depth dimension). Thus, the heating cooker 1 can provide improved convenience.

Furthermore, since the blow-off port 2*c* that is made up of a plurality of small holes facing the heating chamber 2 is provided in the top surface portion 20*c*, the upper surface of an object to be cooked can be heated uniformly by steam flowing downward from the entire upper surface of the heating chamber 2.

Figure 4:
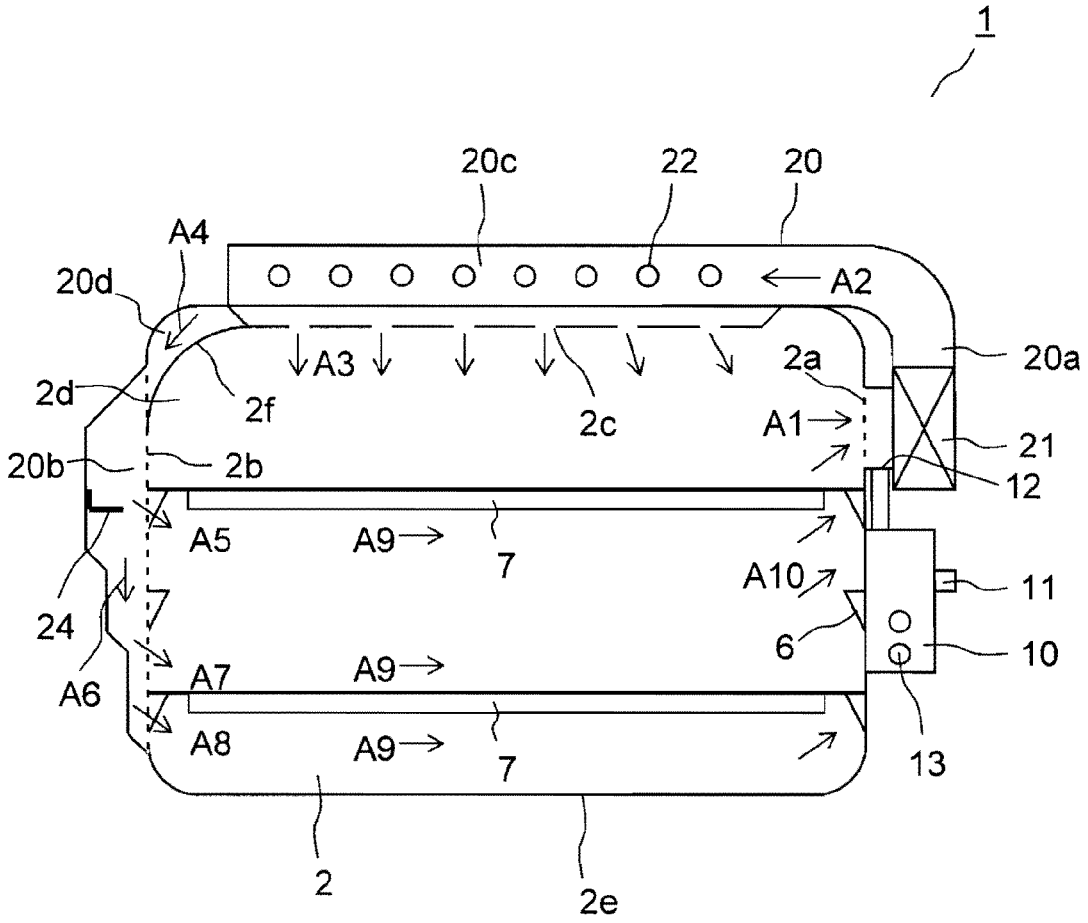
FIG. 4 A cross-sectional front view showing an inner portion of a heating cooker according to a second embodiment of the present invention.

Next, FIG. 4 shows a cross-sectional front view of an inner portion of a heating cooker 1 according to a second embodiment. For the sake of convenience of explanation, like reference symbols denote parts corresponding to those of the aforementioned first embodiment shown in FIGS. 1 to 3. The present embodiment is different from the first embodiment in the configuration of a connection portion 20*d* connecting a top surface portion 2*c* to a second side surface portion 2*b*. Parts other than this are the same as those of the first embodiment.

The top surface portion 2*c* is provided so as to protrude to the inner side of a box-shaped body 2*e*, and a multitude of holes (not shown) are provided on an end surface of the top surface portion 2*c* on the side of the second side surface portion 2*b*. An isolation plate 2*f* that is formed by a curved plate is disposed on the inner side of the box-shaped body 2*e*, and the connection portion 20*d* is formed between the box-shaped body 2*e* and the isolation plate 2*f*. Thus, the outer surface of the connection portion 20*d* is constituted by the box-shaped body 2*e*, and the inner surface thereof is constituted by a wall surface of a heating chamber 2. By use of a thermal insulation material (not shown) covering the box-shaped body 2*e*, the top surface portion 2*c*, and the second side surface portion 20*b*, the connection portion 20*d* is treated to be thermally insulated integrally with the heating chamber 2.

According to the present embodiment, a similar effect to that of the first embodiment can be obtained. Moreover, since the inner surface of the connection portion 20*d* is constituted by the wall surface of the heating chamber 2, there is no need for thermal insulation treatment with respect to the inner surface side of the connection portion 20*d*, and the outer surface side of the connection portion 20*d* can be treated to be thermally insulated integrally with the top surface portion 2*c* and the second side surface portion 20*b*. Thus, thermal insulation treatment with respect to the connection portion 20*d* can be performed more easily than in the case of the connection portion 20*d* made up of pipes according to the first embodiment. Furthermore, the flow path area of the connection portion 20*d* can be easily increased, and thus air blowing efficiency can be improved. Although the isolation plate 2*f* may be a formed by a plane plate, the use of a curved plate can secure a large volume inside the heating chamber 2.

Figure 5:
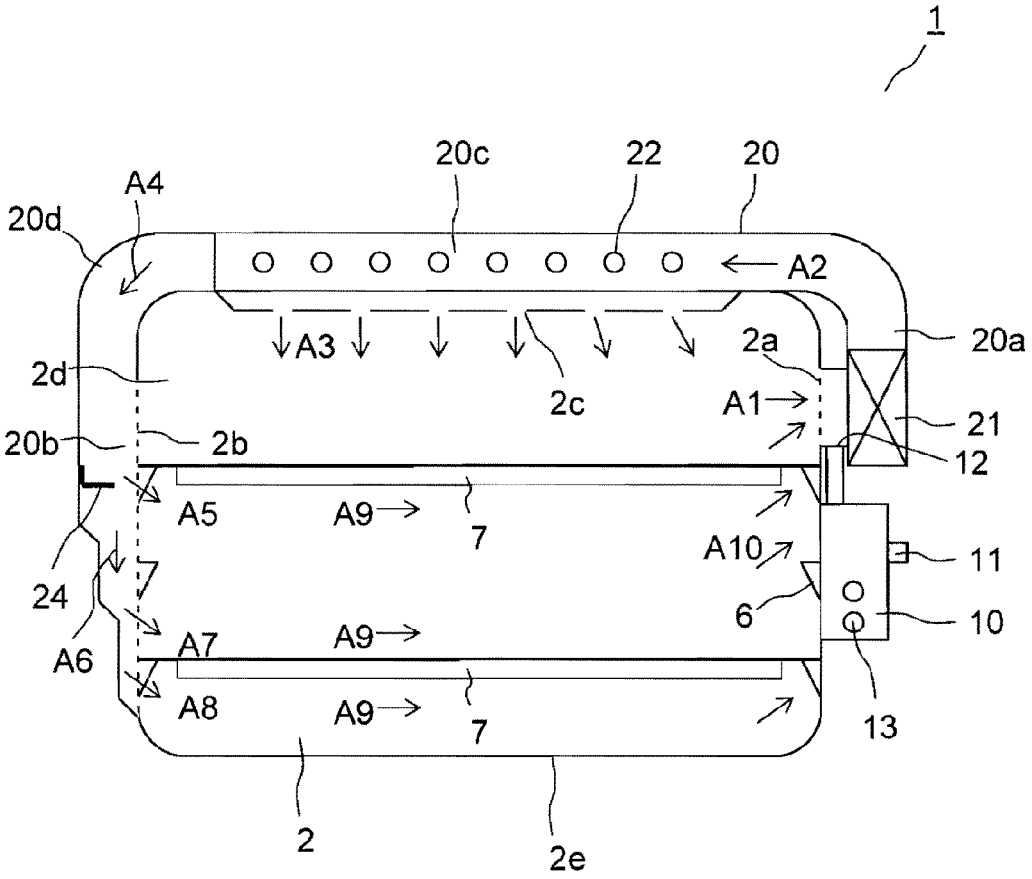
FIG. 5 A cross-sectional front view showing an inner portion of a heating cooker according to a third embodiment of the present invention.

Next, FIG. 5 shows a cross-sectional front view of an inner portion of a heating cooker 1 according to a third embodiment. For the sake of convenience of explanation, like reference symbols denote parts corresponding to those of the aforementioned first embodiment shown in FIGS. 1 to 3. The present embodiment is different from the first embodiment in the configuration of a connection portion 20*d* connecting a top surface portion 2*c* to a second side surface portion 2*b*. Parts other than this are the same as those of the first embodiment.

The respective outer surfaces of the top surface portion 2*c*, the connection portion 20*d*, and the second side surface portion 20*b* are formed integrally using a common member. The inner surface of the connection portion 20*d* is constituted by a wall surface of a heating chamber 2 formed by a box-shaped body 2*e*. By use of a thermal insulation material (not shown) covering the box-shaped body 2*e*, the top surface portion 2*c*, and the second side surface portion 20*b*, the connection portion 20*d* is treated to be thermally insulated integrally with the heating chamber 2.

According to the present embodiment, a similar effect to that of the first embodiment can be obtained. Moreover, since the inner surface of the connection portion 20*d* is constituted by the wall surface of the heating chamber 2, there is no need for thermal insulation treatment with respect to the inner surface side of the connection portion 20*d*, and the outer surface side of the connection portion 20*d* can be treated to be thermally insulated integrally with the top surface portion 2*c* and the second side surface portion 20*b*. Thus, thermal insulation treatment with respect to the connection portion 20*d* can be performed more easily than in the case of the connection portion 20*d* made up of pipes according to the first embodiment. Furthermore, the flow path area of the connection portion 20*d* can be easily increased, and thus air blowing efficiency can be improved. In addition, the amount of heat dissipated from the connection portion 20*d* can be decreased, and thus an energy-saving effect can be obtained.

In the first to third embodiments, the discharge port 12 of the steam supply portion 10 may be configured to be open to the heating chamber 2 so that saturated steam or overheated steam is discharged from the steam supply portion 10 to the heating chamber 2. Furthermore, although in the foregoing embodiments, cooking is performed using steam supplied to the heating chamber 2 by the steam supply portion 10, a heating cooker supplied with no steam is also possible. That is, cooking may be performed using hot air obtained by circulating air in the heating chamber 2 via the circulation duct 20 so that the air is heated.

Furthermore, a separation plate for separating airflow into part flowing downward and part flowing in the direction of the second side surface portion 20*b* may be provided in the top surface portion 20*c*. This allows predetermined amounts of steam to be blown off through the blow-off ports 2*b* and 2*c*, respectively. Thus, the amount of steam to be blown off through the blow-off port 2*c* to heat the upper surface of an object to be cooked at the upper level and the amount of steam to be blown off through the blow-off port 2*b* to heat the lower surface of the object to be cooked and an object to be cooked at the lower level are made appropriate, which allows cooking to be performed in a favorable manner.

Furthermore, the heater 22 may be provided in an inner portion of the second side surface portion 20*b*. This allows higher temperature steam to be blown off through the blow-off port 2*b*. This configuration, therefore, is effective in a case such as where the temperature of steam at the blow-off port 2*b* is desired to be higher than that of steam at the blow-off port 2*c*, and where heat loss occurs along the circulation path at an early stage of heating, resulting in a decrease in the blow-off temperature of steam.

Furthermore, the protrusion 24 provided in the second side surface portion 20*b* may be configured to be movable so that the amount of steam flowing downstream beyond the protrusion 24 can be adjusted. By this configuration, the amounts of steam blown off to upper and lower portions of the heating chamber 2, respectively, can be adjusted. Furthermore, in a case where no object to be cooked is laid on the lower one of the mounting trays 7, it may be set that steam is blown off only to a region upper than the position of the upper one of the mounting trays 7 so that heat loss can be reduced.

INDUSTRIAL APPLICABILITY

The present invention can be applied to a heating cooker that performs cooking by circulating gas in a heating chamber.

LIST OF REFERENCE SYMBOLS

1 Heating cooker
2 Heating chamber
2*a* Suction port
2*b*, 2*c* Blow-off port
2*e* Box-shaped body
2*f* Insulation plate
3 Open/close door
4 See-through window
5 Operation panel
6 Placing base
7 Mounting tray
10 Steam supply portion
11 Water supply port
12 Discharge port
13 Steam generation heater
20 Circulation duct
20*a* First side surface portion
20*b* Second side surface portion
20*c* Top surface portion
20*d* Connection portion
21 Circulation fan
22 Heater
24 Protrusion

The invention claimed is:

1. A heating cooker, comprising:

a heating chamber that has an opening portion at a front surface thereof and houses an object to be cooked;

an open/close door that has a see-through Window and by which the opening portion is opened and closed;

a suction port that is open on one of opposed side walls of the heating chamber;

a blow-off port that is open on the other of the side walls of the heating chamber;

a circulation duct that has first and second side surface portions disposed outside the side walls of the heating chamber, respectively, and connects the suction port provided in the first side surface portion to the blow-off port provided in the second side surface portion;

a circulation fan that is provided in the circulation duct and causes gas in the heating chamber to be sucked through the suction port and blown off through the blow-off port; and a heating portion that is provided in the circulation duct and heats gas flowing through the circulation duct, wherein a plurality of placing bases on which a mounting tray for mounting an object to be cooked is placed are provided in a protruding manner at different vertical levels on an inner wall of the heating chamber, each of the placing bases being formed so as to be separated into a front portion and a rear portion, the mounting tray is disposed so as to stride between the front portion and the rear portion, the suction port is arranged above the placing bases at a highest vertical level and not below the placing bases at the highest vertical level, the blow-off port is arranged to extend from above the placing bases at the highest vertical level to below the placing bases at a lowest vertical level so as to be located between the front and rear portions of each of the placing bases, a length of the blow-off port in a front-rear direction is smaller than a length of the suction port in a the front-rear direction, the circulation duct connects the first and second side surface portions to each other via a top surface portion provided above the heating chamber, a plurality of small holes facing the heating chamber are provided in the top surface portion, and the heating portion is disposed in the top surface portion.

2. The heating cooker according to claim 1, wherein a protrusion that protrudes in a direction of the heating chamber is provided inside the circulation duct, on an inner wall of the second side surface portion, which is distant from the heating chamber.

3. The heating cooker according to claim 1, wherein a connection portion is provided that connects the top surface portion to the second side surface portion and thus makes the circulation duct bent, and an inner surface of the connection portion is constituted by a wall surface of the heating chamber.

4. The heating cooker according to claim 3, wherein a box-shaped body of a closed-bottom tubular shape is provided that is formed by a single member constituting peripheral and back surfaces of the heating chamber, the top surface portion protrudes to an inner side of the box-shaped body, and the inner surface of the connection portion is constituted by an isolation plate disposed on the inner side of the box-shaped body.

5. The heating cooker according to claim 4, wherein the isolation plate is formed by a curved plate.

6. The heating cooker according to claim 3, wherein respective outer surfaces of the top surface portion, the connection portion, and the second side surface portion are formed integrally using a common member.

7. The heating cooker according to claim 1, wherein a steam supply portion that supplies steam to the heating chamber is provided, and the steam supply portion supplies steam from outside the circulation duct to a part of the circulation duct between the suction port and the circulation fan.

8. The heating cooker according to claim 2, wherein a steam supply portion that supplies steam to the heating chamber is provided, and the steam supply portion supplies steam from outside the circulation duct to a part of the circulation duct between the suction port and the circulation fan.

9. The heating cooker according to claim 3, wherein a steam supply portion that supplies steam to the heating chamber is provided, and the steam supply portion supplies steam from outside the circulation duct to a part of the circulation duct between the suction port and the circulation fan.

10. The heating cooker according to claim 4, wherein a steam supply portion that supplies steam to the heating chamber is provided, and the steam supply portion supplies steam from outside the circulation duct to a part of the circulation duct between the suction port and the circulation fan.

11. The heating cooker according to claim 5, wherein a steam supply portion that supplies steam to the heating chamber is provided, and the steam supply portion supplies steam from outside the circulation duct to a part of the circulation duct between the suction port and the circulation fan.

12. The heating cooker according to claim 6, wherein a steam supply portion that supplies steam from outside the circulation duct to the heating chamber is provided, and the steam supply portion supplies steam to a part of the circulation duct between the suction port and the circulation fan.

* * * * *